US006427783B2

(12) United States Patent
Krueger et al.

(10) Patent No.: US 6,427,783 B2
(45) Date of Patent: Aug. 6, 2002

(54) STEERABLE MODULAR DRILLING ASSEMBLY

(75) Inventors: Volker Krueger, Celle; Hans Rehbock; Thomas Kruspe, both of Wienhausen; Johannes Witte, Braunschweig; Detlef Ragnitz, Dussel-Hornoldendorf, all of (DE)

(73) Assignee: Baker Hughes Incorporated, Houston, TX (US)

( * ) Notice: Subject to any disclaimer, the term of this patent is extended or adjusted under 35 U.S.C. 154(b) by 5 days.

(21) Appl. No.: 09/758,065

(22) Filed: Jan. 10, 2001

Related U.S. Application Data

(60) Provisional application No. 60/175,758, filed on Jan. 12, 2000.

(51) Int. Cl.[7] ..... E21B 47/00

(52) U.S. Cl. ..... 175/40; 175/50; 175/325.3

(58) Field of Search ..... 175/24, 40, 26, 175/27, 45, 48, 50, 61, 325.3, 41, 38

(56) References Cited

U.S. PATENT DOCUMENTS

| | | | | |
|---|---|---|---|---|
| 5,332,048 A | * | 7/1994 | Underwood et al. | 175/26 |
| 5,419,405 A | | 5/1995 | Patton | 175/27 |
| 5,812,068 A | * | 9/1998 | Wisler et al. | 340/855.5 |
| 5,842,149 A | * | 11/1998 | Harrell et al. | 702/9 |
| 5,924,499 A | * | 7/1999 | Birchak et al. | 175/40 |
| 5,947,213 A | * | 9/1999 | Angle et al. | 175/24 |
| 6,088,294 A | * | 7/2000 | Leggett, III et al. | 367/25 |

FOREIGN PATENT DOCUMENTS

| | | |
|---|---|---|
| FR | 1 008 717 A1 | 6/2000 |
| GB | 2 285 651 | 3/1995 |
| GB | 0 728 908 A2 | 8/1996 |
| WO | WO 99/45234 | 9/1999 |

* cited by examiner

*Primary Examiner*—Frank Tsay
(74) *Attorney, Agent, or Firm*—Madan, Mossman & Sriram, P.C.

(57) ABSTRACT

In general, the present invention provides a modular drilling assembly having a module for contactless power and data transfer over a nonconductive gap between rotating and non-rotating members of a steering module. The gap usually contains a non-conductive fluid, such as drilling fluid, or oil for operating hydraulic devices in the downhole tool. The downhole tool in one embodiment is a modular drilling assembly wherein a drive shaft is rotated by a downhill motor to rotate a drill bit attached to the bottom end of the drive shaft. A substantially non-rotating sleeve around the drive shaft includes at least one electrically-operated device. The drilling assembly is modular in that it includes at least one steering module at the bottom end of the drilling assembly that has at least one steering device module that provides power to the force application member. A power and data communication uphole of the steering module provides power to the steering module and data communication between the drilling assembly and the surface.

23 Claims, 8 Drawing Sheets

FIG. 1

STEERABLE MODULAR DRILLING ASSEMBLY

CROSS-REFERENCE TO RELATED APPLICATION

This application takes priority from U.S. Provisional Patent Application Ser. No. 60/175,758, filed Jan. 12, 2000, assigned to the assignee of this application, and which is hereby incorporated herein by reference in its entirety.

BACKGROUND OF THE INVENTION

1. Field of the Invention

This invention relates generally to oilfield downhole tools and more particularly to modular drilling assemblies utilized for drilling wellbores in which electrical power and data are transferred between rotating and non-rotating sections of the drilling assembly.

2. Description of the Related Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of the current drilling activity involves drilling of deviated and horizontal wellbores to more fully exploit hydrocarbon reservoirs. Such boreholes can have relatively complex well profiles. To drill such complex boreholes, drilling assemblies are utilized which include a plurality of independently operable force application members to apply force on the wellbore wall during drilling of the wellbore to maintain the drill bit along a prescribed path and to alter the drilling direction. Such force application members may be disposed on the outer periphery of the drilling assembly body or on a non-rotating sleeve disposed around the rotating drive shaft. These force application members are moved radially to apply force on the wellbore in order to guide the drill bit and/or to change the drilling direction outward by electrical devices or electro-hydraulic devices. In such drilling assemblies, there exists a gap between the rotating and the non-rotating sections. To reduce the overall size of the drilling assembly and to provide more power to the ribs, it is desirable to locate the devices (such as motor and pump) required to operate the force application members in the non-rotating section. It is also desirable to locate electronic circuits and certain sensors in the non-rotating section. Thus, power must be transferred between the rotating section and the non-rotating section to operate electrically-operated devices and the sensors in the non-rotating section. Data also must be transferred between the rotating and the non-rotating sections of such a drilling assembly. Sealed slip rings are often utilized for transferring power and data. The seals often break causing tool failures downhole.

In drilling assemblies which do not include a non-rotating sleeve as described above, it is desirable to transfer power and data between the rotating drill shaft and the stationary housing surrounding the drill shaft. The power transferred to the rotating shaft may be utilized to operate sensors in the rotating shaft and/or drill bit. Power and data transfer between rotating and non-rotating sections having a gap therebetween can also be useful in other downhole tool configurations.

The present invention provides contactless inductive coupling to transfer power and data between rotating and non-rotating sections of downhole oilfield tools, including the drilling assemblies containing rotating and non-rotating members.

SUMMARY OF THE INVENTION

In general, the present invention provides apparatus and method for power and data transfer over a nonconductive gap between rotating and non-rotating members of downhole oilfield tools. The gap may contain a non-conductive fluid, such as drilling fluid or oil for operating hydraulic devices in the downhole tool. The downhole tool, in one embodiment, is a drilling assembly wherein a drive shaft is rotated by a downhole motor to rotate the drill bit attached to the bottom end of the drive shaft. A substantially non-rotating sleeve around the drive shaft includes a plurality of independently-operated force application members, wherein each such member is adapted to be moved radially between a retracted position and an extended position. The force application members are operated to exert the force required to maintain and/or alter the drilling direction. In the preferred system, a common or separate electrically-operated hydraulic unit provide energy (power) to the force application members. An inductive coupling transfer device transfers electrical power and data between the rotating and non-rotating members. An electronic control circuit or unit associated with the rotating member controls the transfer of power and data between the rotating member and the non-rotating member. An electrical control circuit or unit carried by the non-rotating member controls power to the devices in the non-rotating member and also controls the transfer of data from sensors and devices carried by the non-rotating member to the rotating member.

In an alternative embodiment of the invention, an inductive coupling device transfers power from the non-rotating housing to the rotating drill shaft. The electrical power transferred to the rotating drill shaft is utilized to operate one or more sensors in the drill bit and/or the bearing assembly. A control circuit near the drill bit controls transfer of data from the sensors in the rotating member to the non-rotating housing.

The inductive coupling may also be provided in a separate module above the mud motor to transfer power from a non-rotating section to the rotating member of the mud motor and the drill bit. The power transferred may be utilized to operate devices and sensors in the rotating sections of the drilling assembly, such as the drill shaft and the drill bit. Data is transferred from devices and sensors in the rotating section to the non-rotating section via the same or a separate inductive coupling. Data in the various embodiments is preferably transferred by frequency modulation.

The drilling assembly is modular, in that relatively easily connectable modules make up the drilling assembly. The modular drilling assembly includes at least a steering module that carries the drill bit and includes a non-rotating sleeve that includes a plurality of pluggable steering device modules. A power and data communication module uphole of the steering module provides power to the steering module and two-way data communication between the steering module and the remaining drilling assembly. A subassembly containing multipropagation sensitivity sensors and gamma ray sensors is disposed uphole of the steering module. This subassembly may include a memory module and a vibration module. A directional module containing sensors for determining the drilling assembly direction is preferably disposed uphole of the resistivity and gamma sensor subassembly. Modular subassemblies make up portions of the steering assembly. The primary electronics, secondary electronics inductive coupling transformers of the steering module are also individual pluggable modules.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
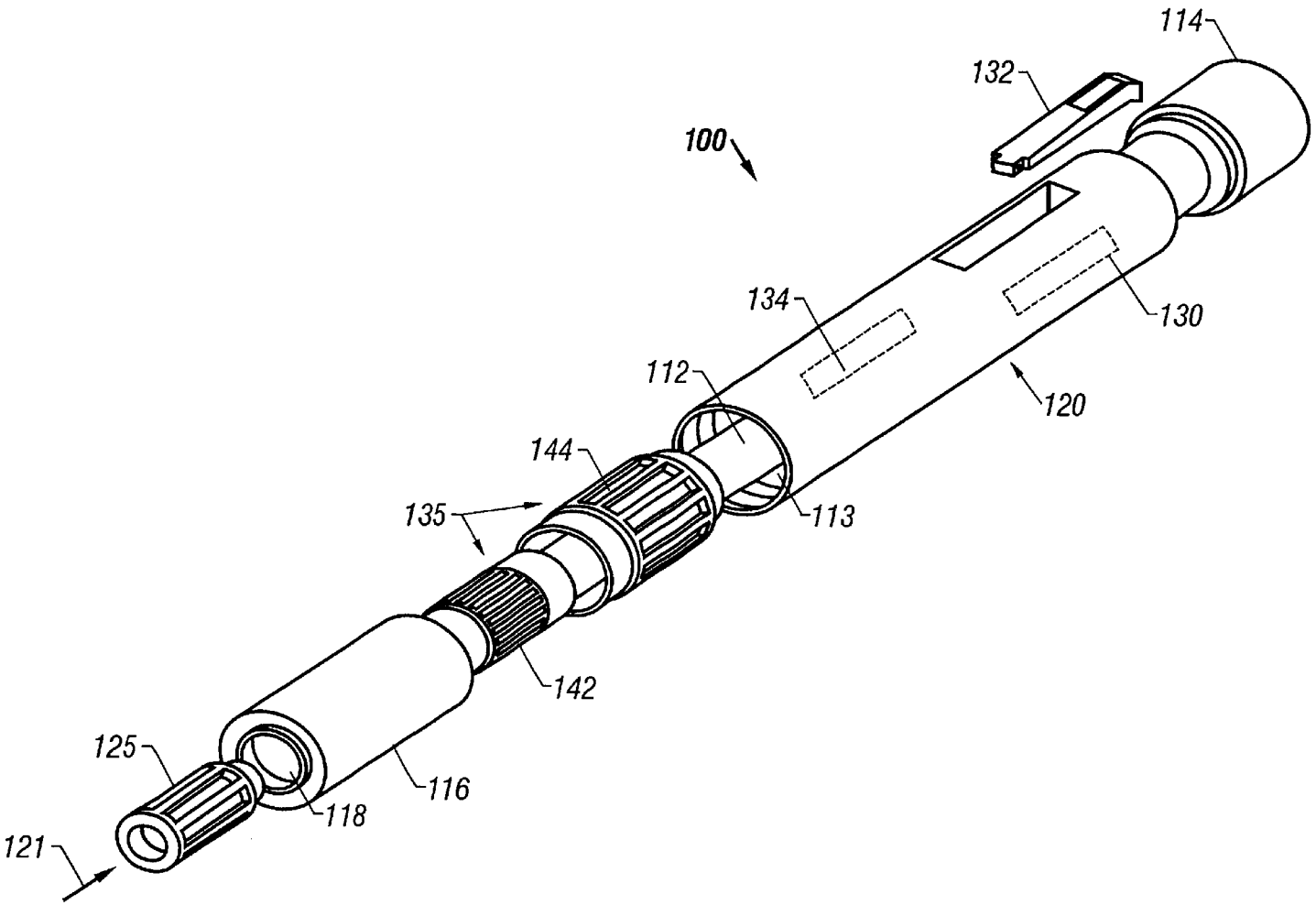
FIG. 1 is an isometric view of a section of a drilling assembly showing the relative position of a rotating drive shaft (the "rotating member") and a non-rotating sleeve (the "non-rotating member") and an electrical power and data transfer device for transferring power and data between the rotating and non-rotating members across a non-conductive gap according to one embodiment of the present invention.

FIG. 1 is an isometric view of a section or portion 100 of a drilling assembly showing the relative position of a rotating drive shaft 110 (rotating member) and a non-rotating sleeve 120 (non-rotating member) with a non-conductive gap therebetween and an electric power and data transfer device 135 for transferring power and data between the rotating drive shaft and the non-rotating sleeve over a non-conductive gap 113, according to one embodiment of the present invention.

Section 100 forms the lowermost part of the drilling assembly. The drive shaft 110 has a lower drill bit section 114 and an upper mud motor connection section 116. A reduced diameter hollow shaft 112 connects the sections 114 and 116. The drive shaft 110 has a through bore 118 which forms the passageway for drilling fluid 121 supplied under pressure to the drilling assembly from a surface location. The upper connection section 116 is coupled to the power section of a drilling motor or mud motor (not shown) via a flexible shaft (not shown). A rotor in the drilling motor rotates the flexible shaft, which in turn rotates the drive shaft 110. The lower section 114 houses a drill bit (not shown) and rotates as the drive shaft 110 rotates. A substantially non-rotating sleeve 120 is disposed around the drive shaft 110 between the upper connection section 116 and the drill bit section 114. During drilling, the sleeve 120 may not be completely stationary, but rotates at a very low rotational speed relative to the rotation of the drive shaft 110. Typically, the drill shaft rotates between 100 to 600 revolutions per minute (r.p.m.) while the sleeve 120 may rotate at less than 2 r.p.m. Thus, the sleeve 120 is substantially non-rotating with respect to the drive shaft 110 and is, therefore, referred to herein as the substantially non-rotating or non-rotating member or section. The sleeve 120 includes at least one device 130 that requires electric power. In the configuration of FIG. 1, the device 130 operates one or more force application members, such as member 132.

The electric power transfer device 135 includes a transmitter section 142 attached to the outside periphery of the rotating drive shaft 112 and a receiver section 144 attached to the inside of the non-rotating sleeve 120. In the assembled downhole tool, the transmitter section 142 and the receiver section 144 are separated by an air gap between the two sections. The outer dimensions of the transmitter section 142 are smaller than the inner dimension of the receiver section 144 so that the sleeve 120 with the receiver section 144 attached thereto can slide over the transmitter section 142. An electronic control circuit 125 (also referred to herein as the "primary electronics") in the rotating member 110 provides the desired electric power to the transmitter 142 and also controls the operation of the transmitter 142. The primary electronics 125 also provides the data and control signals to the transmitter section 142, which transfers the electric power and data to the receiver 144. A secondary electronic control circuit (also referred to herein as the "secondary electronics") is carried by the non-rotating sleeve 120. The secondary electronics 134 receives electric energy from the receiver 144, controls the operation of the electrically-operated device 130 in the non-rotating member 120, receives measurement signals from sensors in the non-rotating section 120, and generates signals which are transferred to the primary electronics via the inductive coupling of the data transfer device 135. The transfer of electric power and data between the rotating and non-rotating members are described below with reference to FIGS. 2 through 3B.

Figure 2:
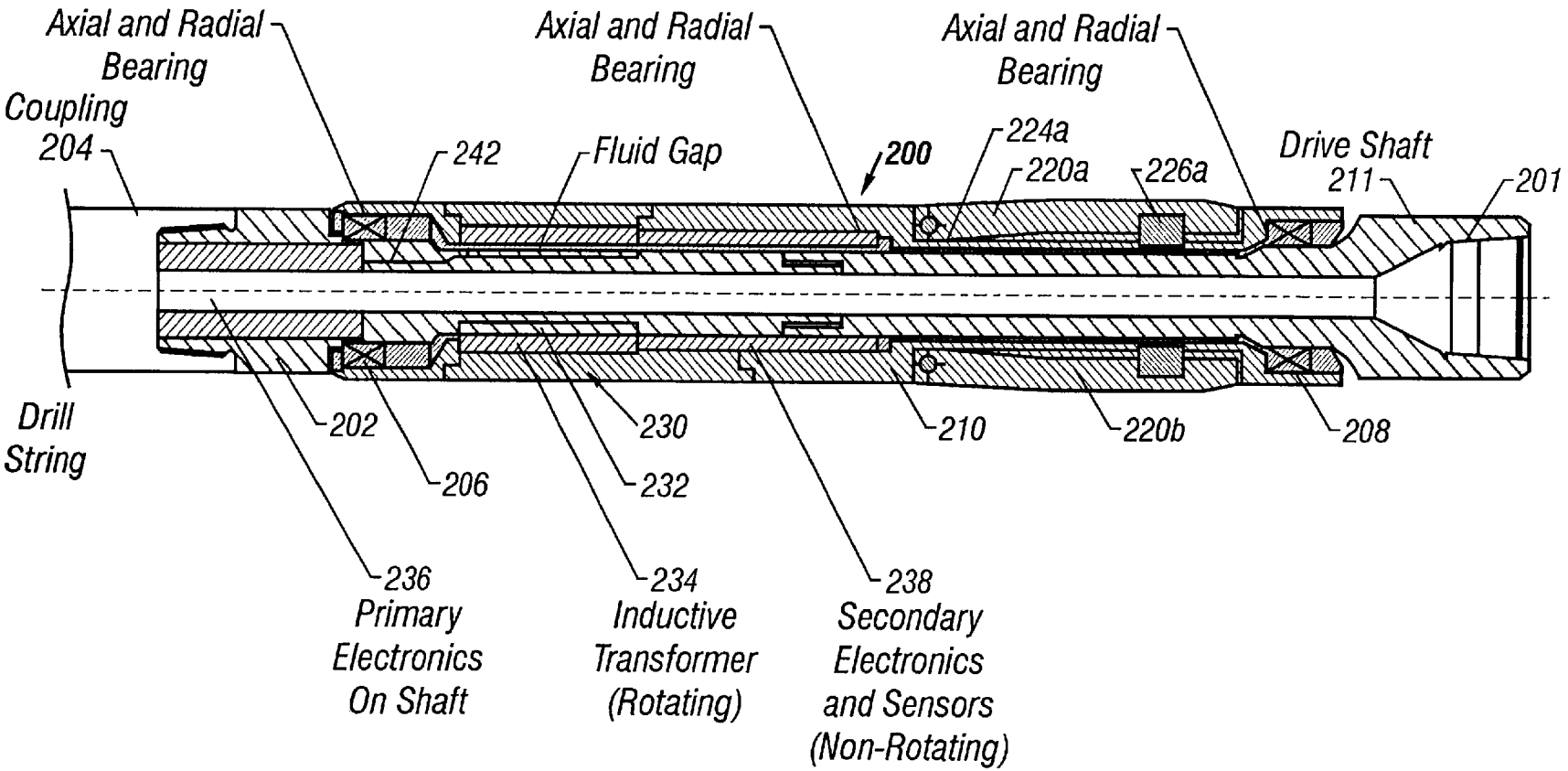
FIG. 2 is a line diagram of a section of a drilling assembly showing the electrical power and data transfer device and the electrical control circuits for transferring power and data between the rotating and non-rotating sections of the drilling assembly according to one embodiment of the present invention.

FIG. 2 is a line diagram of a bearing assembly 200 section of a drilling assembly which shows, among other things, the relative placement of the various elements shown in FIG. 1. The bearing assembly 200 has a drive shaft 211 which is attached at its upper end 202 to a coupling 204, which in turn is attached to a flexible rod that is rotated by the mud motor in the drilling assembly. A non-rotating sleeve 210 is placed around a section of the drive shaft 211. Bearings 206 and 208 provide radial and axial support to the drive shaft 211 during drilling of the wellbore. The non-rotating sleeve 210 houses a plurality of expandable force application members, such as members 220*a*–220*b* (ribs). The rib 220*a* resides in a cavity 224*a* in the sleeve 210. The cavity 224*a* also includes sealed electro-hydraulic components for radially expanding the rib 220*a*. The electro-hydraulic components may include a motor that drives a pump, which supplies fluid under pressure to a piston 226*a* that moves the rib 220*a* radially outward. These components are described below in more detail in reference to FIGS. 3A and 3B.

An inductive coupling data transfer device 230 transfers electric power between the rotating and non-rotating members. The device 230 includes a transmitter section 232 carried by the rotating member 211 and a receiver section 234 carried by the non-rotating sleeve 210. The device 230 preferably is an inductive device, in which both the transmitter and receiver include suitable coils. Primary control electronics 236 is preferably placed in the upper coupling section 204. Other sections of the rotating member may also be utilized for housing part or all of the primary electronics 236. A secondary electronics module 238 is preferably placed adjacent to the receiver 234. Conductors and communication links 242 placed in the rotating member 211 transfer power and data between the primary electronics 236 and the transmitter 232. Power in downhole tools such as shown in FIG. 2, is typically generated by a turbine rotated by the drilling fluid supplied under pressure to the drilling assembly. Power may also be supplied from the surface via electrical lines in the tubing.

Figure 3A:
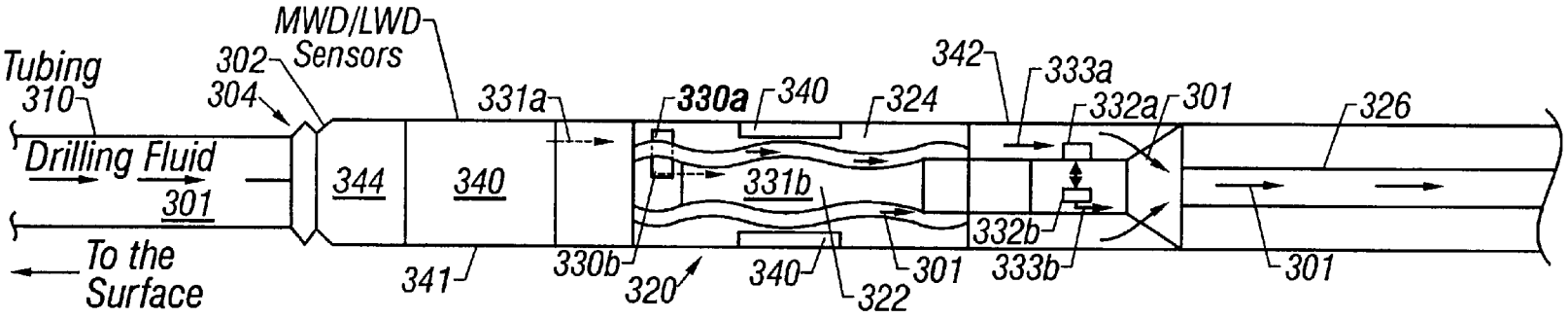
FIGS. 3A and 3B show a schematic functional block diagram relating to the power and data transfer device shown in FIGS. 1–2 and for operating a device in the non-rotating section utilizing the power transferred from the rotating to the non-rotating sections.
Figure 3B:
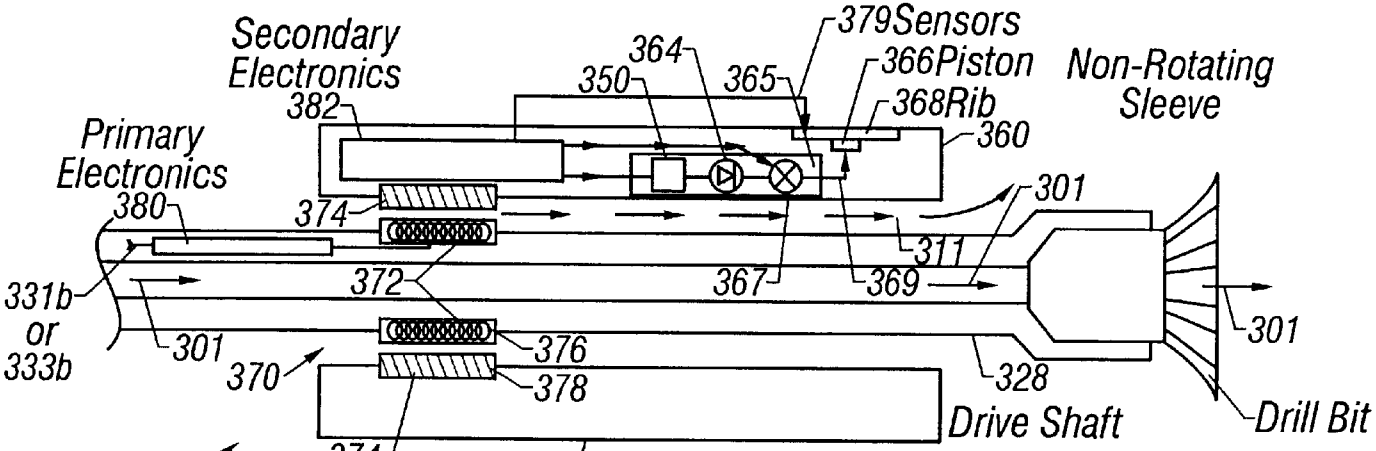

FIGS. 3A and 3B show a block functional diagram of a drilling assembly 300 that depicts the method for power and data transfer between the rotating and non-rotating sections of the drilling assembly. Drilling assemblies or BHA's used for drilling wellbores and for providing various measurements-while-drilling measurements are well known in the art and, therefore, their detailed layout or functions are not described herein. The description given below is primarily in the context of transferring electric power and data between rotating and non-rotating members.

Still referring to FIGS. 3A and 3B, the drilling assembly 300 is coupled at its top end or uphole end 302 to a tubing 310 via a coupling device 304. The tubing 310, which is usually a jointed pipe or a coiled tubing, along with the drilling assembly 300 is conveyed from a surface rig into the wellbore being drilled. The drilling assembly 300 includes a mud motor 320 that has a rotor 322 inside a stator 324. Drilling fluid 301 supplied under pressure to the tubing 310 passes through the mud motor power section 320, which rotates the rotor 322. The rotor 322 drives a flexible coupling shaft 326, which in turn rotates the drive shaft 328. A variety of measurement-while-drilling ("MWD") or logging-while-drilling sensors ("LWD"), generally referenced herein by numeral 340, carried by the drilling assembly 300 provide measurements for various parameters, including borehole parameters, formation parameters, and drilling assembly health parameters. These sensors may be placed in a separate section, such as a section 341, or disposed in one or more sections of the drilling assembly 300. Usually, some of the sensors are placed in the housing 342 of the drilling assembly 300.

Electric power is usually generated by a turbine 344 driven by the drilling fluid 301. Electric power also may be supplied from the surface via appropriate conductors. In the exemplary system shown in FIG. 3, the drive shaft 328 is the rotating member and the sleeve 360 is the non-rotating member. The preferred power and data transfer device 370 is an inductive transformer, which includes a transmitter section 372 carried by the rotating member 328 and a receiver section 374 placed in the non-rotating sleeve 360 opposite from the transmitter 372. The transmitter 372 and receiver 374 respectively contain coils 376 and 378. Power to the coils 376 is supplied by the primary electrical control circuit 380. The turbine 344 generates a.c. voltage. The primary electronics 380 conditions a.c. voltage and supplies it to the coils 376. The rotation of the drill shaft 328 induces current into the receiver section 374, which delivers a.c. voltage as the output. The secondary control circuit or the secondary electronics 382 in the non-rotating member 360 converts the a.c. voltage from the receiver 372 to d.c. voltage. The. d.c. voltage is then utilized to operate various electronic components in the secondary electronics and any electrically-operated devices. Drilling fluid 301 usually fills the gap 311 between the rotating and non-rotating members 328 and 360.

Still referring to FIGS. 3A and 3B and as noted above, a motor 350 operated by the secondary electronics 382 drives a pump 364, which supplies a working fluid, such as oil, from a source 365 to a piston 366. The piston 366 moves its associated rib 368 radially outward from the non-rotating member 360 to exert force on the wellbore wall. The pump speed is controlled or modulated to control the force applied by the rib on the wellbore wall. Alternatively, a fluid flow control valve 367 in the hydraulic line 369 to the piston may be utilized to control the supply of fluid to the piston and thereby the force applied by the rib 368. The secondary electronics 362 controls the operation of the valve 360. A plurality of spaced apart ribs (usually three) are carried by the non-rotating member 360, each rib being independently operated by a common or separate secondary electronics.

The secondary electronics 382 receives signals from sensors 379 carried by the non-rotating member 360. At least one of the sensors 379 provides measurements indicative of the force applied by the rib 368. Each rib has a corresponding sensor. The secondary electronics 382 conditions the sensor signals and may compute values of the corresponding parameters and supplies signals indicative of such parameters to the receiver section 374, which transfers such signals to the transmitter 372. A separate transmitter and receiver may be utilized for transferring data between rotating and non-rotating sections. Frequency modulating techniques, known in the art, may be utilized to transfer signals between the transmitter and receiver or vice versa. The signals from the primary electronics may include command signals for controlling the operation of the devices in the non-rotating sleeve.

In an alternative embodiment, the primary electronics and the transmitter are placed in the non-rotating section while the secondary electronics and receiver are located in the rotating section of the downhole tool, thereby transferring electric power from the non-rotating member to the rotating member. These embodiments are described below in more detail with reference to FIG. 4.

Thus, in one aspect of the present invention, electric power and data are transferred between a rotating drill shaft and a non-rotating sleeve of a drilling assembly via an inductive coupling. The transferred power is utilized to operate electrical devices and sensors carried by the non-rotating sleeve. The role of the transmitter and receiver may be reversed.

Figure 4:
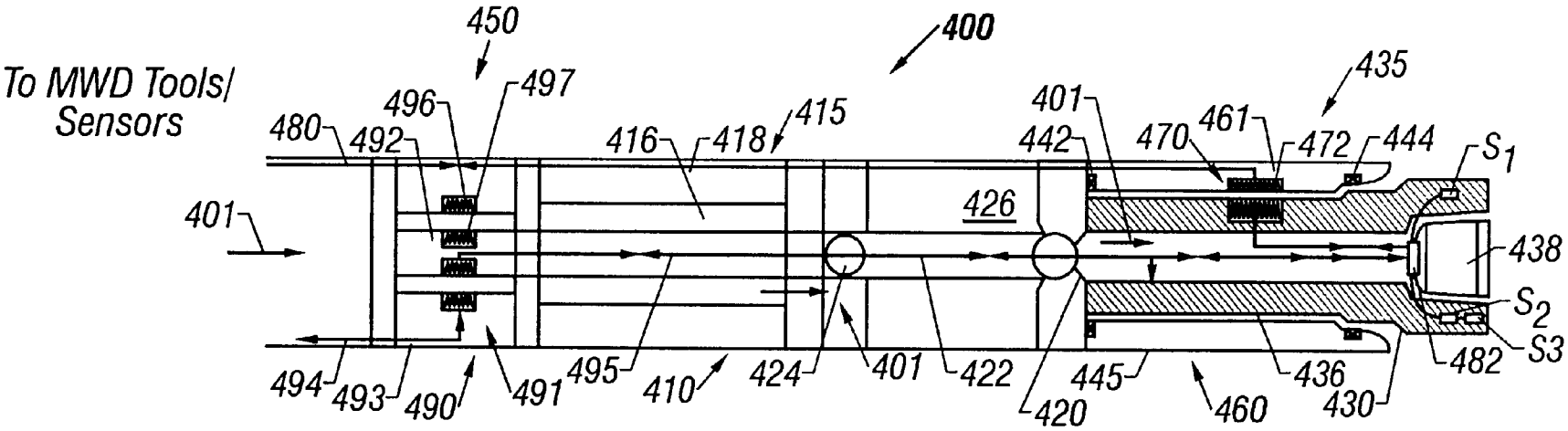
FIG. 4 is a schematic diagram of a portion of a drilling assembly, wherein an inductive coupling is shown disposed in two alternative locations for transferring power and data between rotating and non-rotating members.

FIG. 4 is a schematic diagram of a portion 400 of a drilling assembly which shows two alternative arrangements for the power and data transfer device. FIG. 4 shows a drilling motor section 415 that includes a rotor 416 disposed in a stator 418. The rotor 416 is coupled to a flexible shaft 422 at a coupling 424. A drill shaft 430 is connected to a lower end 420 of the flexible shaft 422. The drill shaft 430 is disposed in a bearing assembly with a gap 436 therebetween. Drilling fluid 401 supplied under pressure from the surface passes through the power section 410 of the motor 400 and rotates the rotor 416. The rotor rotates the flexible shaft 422, which in turn rotates the drill shaft 430. A drill bit (not shown) housed at the bottom end 438 of the drill shaft 430 rotates as the drill shaft rotates. Bearings 442 and 444 provide radial and axial stability to the drill shaft 430. The upper end 450 of the motor power section 410 is coupled to MWD sensors via suitable connectors. A common or continuous housing 445 may be utilized for the mud motor section 415.

In one embodiment, power and data are transferred between the bearing assembly housing 461 and the rotating drive shaft 430 by an inductive coupling device 470. The transmitter 471 is placed on the stationary housing 461 while the receiver 472 is placed on the rotating drive shaft 430. One or more power and data communication links 480 are run from a suitable location above the mud motor 410 to the transmitter 471. Electric power may be supplied to the power and communication links 480 from a suitable power source in the drilling assembly 400 or from the surface. The communication links 480, may be coupled to a primary control electronics (not shown) and the MWD devices. A variety of sensors, such as pressure sensor $S_1$, temperature sensors $S_2$, vibration sensors $S_3$ etc. are placed in the drill bit.

The secondary control electronics 482 converts the a.c. voltage from the receiver to d.c. voltage and supplies it to the various electronic components in the circuit 482 and to the sensors $S_1$–$S_3$. The control electronics 482 conditions the sensor signals and transmits them to the data transmission section of the device 470, which transmits such signals to the transmitter 471. These signals are then utilized by a primary electronics in the drilling assembly 400. Thus, in the embodiment described above, an inductive coupling device transfers electric power from a non-rotating section of the bearing assembly to a rotating member. The inductive coupling device also transfers signals between these rotating and non-rotating members. The electric power transferred to the rotating member is utilized to operate sensors and devices in the rotating member. The inductive devices also establishes a two-way data communication link between the rotating and non-rotating members.

In an alternative embodiment, a separate subassembly or module 490 containing an inductive device 491 may be disposed above or uphole of the mud motor 415. The module 490 includes a member 492, rotatably disposed in a non-rotating housing 493. The member 492 is rotated by the mud motor 410. The transmitter 496 is disposed on the non-rotating housing 493 while the receiver 497 is attached to the rotating member 492. Power and signals are provided to the transmitter 496 via conductors 494 while the received power is transferred to the rotating sections via conductors 495. The conductors 495 may be run through the rotor, flexible shaft and the drill shaft. The power supplied to the rotating sections may be utilized to operate any device or sensor in the rotating sections as described above. Thus, in this embodiment, electric power is transferred to the rotating members of the drilling assembly by a separate module or unit above the mud motor.

Figure 5:
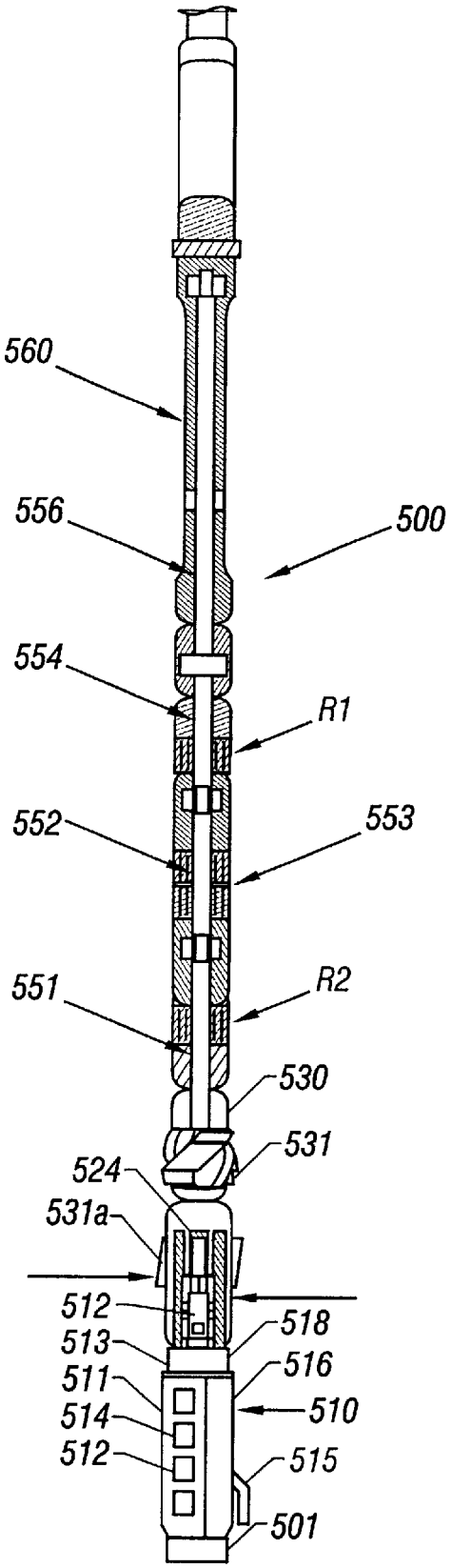
FIG. 5 is a modular drilling assembly according to one embodiment of the present invention.

The drilling assemblies described above preferably are modular, in that relatively easily connectable modules makeup the drilling assembly. Modular construction is preferred for ease of manufacturing, repairing of the drilling assembly and interchangeability of modules in the field. FIG. 5 shows a modular drilling, assembly 500 according to one embodiment of the present invention. The lowermost module 510 preferably is a steering module 510 having a drill bit 501 at its bottom end. The steering module 510 performs the same functions as assembly 200 shown in FIG. 2. The steering module 510 includes a non-rotating sleeve 511 which carries a plurality of modular steering devices 512 and modular ribs 515 which are described in more detail in reference to FIG. 6. The steering module 510 preferably includes the inductive coupling power and data transfer devices described above with respect to FIGS. 1–3B. The steering module 510 also preferably includes sensors and electronics 514 (near bit inclination devices) for determining the inclination of the drilling assembly 500. The near bit inclination devices 514 may include three (3) axis accelerometers, gyroscopic devices and signal processing circuitry as generally known in the art. A gamma ray device 516 on the non-rotating sleeve 511 provides information about changes in the formation as the drilling progresses from one type of a formation to another.

A bidirectional power and data communication module ("BPCM") module 520 uphole of the steering module 510 provides power to the steering unit 510 and two-way data communication between the drilling assembly 500 and surface devices. The power in the BPCM is preferably generated by a mud-driven alternator 522. The data signals are preferably generated by a mud pulser 524. The mud-driven power generation units (mud pursers) are known in the art thus not described in greater detail. The BPCM preferably is separate module that can be attached to the upper end 513 of the steering module 510 via a suitable connector mechanism 518. Although, FIG. 5 shows BPCM attached to the upper end of the steering module, it however, may be placed at any other suitable location in the drilling assembly 500. A number of additional modules also are provided to make up the entire drilling assembly. The steering module 510 and BPCM 520 include certain additional modular features, which are described next in reference to FIG. 6 prior to describing the additional modules of the drilling assembly 500.

Figure 6:
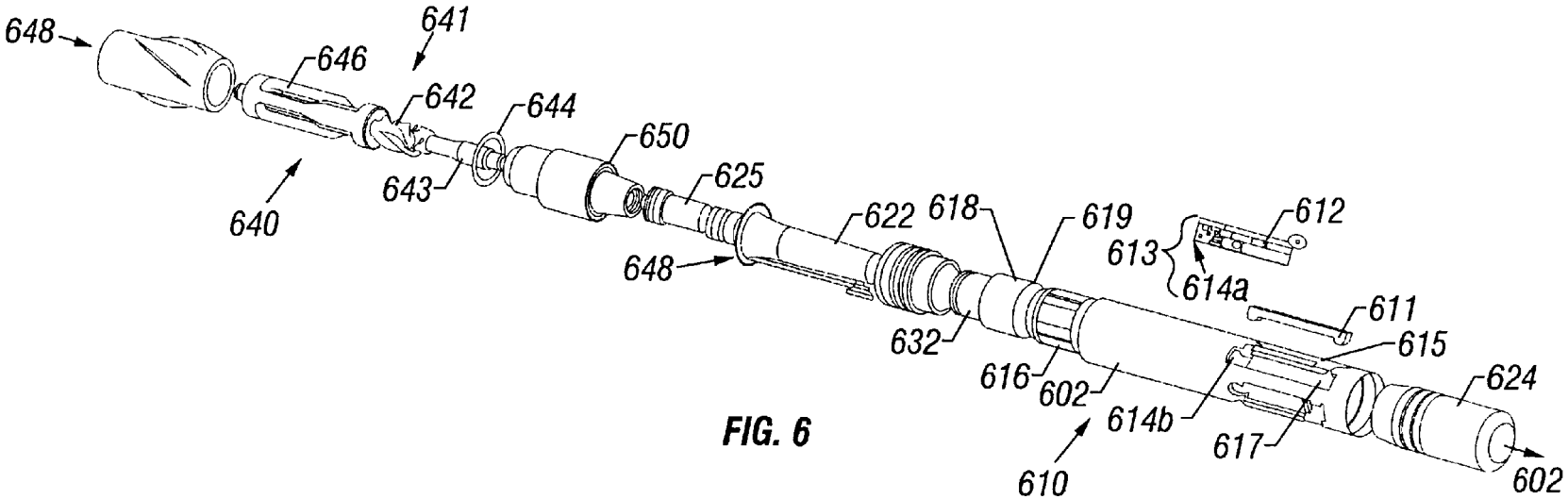
FIG. 6 is an isometric view showing the relative placement of certain major components of the steering module and the bidirectional power and data communication modules shown in FIG. 5.

FIG. 6 is an isometric view 600 showing in greater detail certain modular and other features within the steering module 510 (610 in FIG. 6) and BPCM 520 (640 in FIG. 6) shown in FIG. 5. The non-rotating sleeve 601 includes a plurality of steering devices 613, each containing a rib 611 and a plugable self-contained hydraulic power unit or module 612. The hydraulic power module 612 plugs into the secondary electronics 616 disposed inside the non-rotating sleeve 601 via a connector 614*a* coupled to the hydraulic power module 612 and a mating connector 614*b* coupled to the secondary electronics 616. Each hydraulic power unit 612 preferably is sealed and includes a motor, a pump and hydraulic fluid to drive a piston, which moves an associated rib 611 radially outward. A separate recess, such as recess 617, is provided in the non-rotating sleeve for accommodating each hydraulic power unit 612 and its associated rib 611. At least one sensor 615 (such as a pressure sensor) provides signals to the secondary electronics 616 corresponding to or representative of the force applied by its associated rib 611 to the wellbore. Other sensors, such as dispacement measuring sensors, may also be utilized to determine the amount of force applied by each rib 611 on the wellbore. The secondary or outer part 618 of the inductive coupling is electrically coupled to the secondary electronics 616 via a plugable pin connector 619 associated with the secondary electronics 616. Thus, the steering module 610 described thus far includes a non-rotating sleeve 601 which has a plurality of plugable, self-contained steering rib hydraulic power units 612 (one for each rib), a plugable secondary electronics 616 (attached to the inside of the non-rotating sleeve) and plugable outer coils 618 of the inductive coupling which are attached to the inside of the non-rotating sleeve 601.

An upper drive shaft 622 runs through the non-rotating sleeve 601 and is coupled to a lower drive shaft 624, which drives the drill bit 602. The primary electronics 625 is coupled to the outside of the upper drive shaft 622. Primary coils or inner part 632 of the inductive coupling is plugably connected to the primary electronics 625. Thus, in one embodiment, the steering module 610 includes (i) a non-rotating sleeve with a plurality of self-contained and sealed plugable hydraulic power units, one for each rib, (ii) a primary electronics module that plugs into a primary inductive coupling coil module; and (iii) a secondary electronics module that is plugably connected to the secondary inductive coupling coils and each of the hydraulic power units.

Still referring to FIG. 6, the BPCM 640 disposed uphole or above steering unit 610, contains an electric power generation unit 641 that includes a turbine 642 which is driven by the drilling fluid (mud) 648 supplied under pressure from the surface. The turbine 642 rotates an alternator 643 which supplies electrical power to the steering unit 610 via a double pin adapter 650. A ring connector 644 on the adapter 650 and a ring connector 648 on the upper drive shaft 622 transfer power and data between the power generation unit 641 and the primary electronics 625. In an alternative embodiment, the ring connector 644 may be built into the BPCM, thereby eliminating the adapter 650. A pulser in the BPCM generates telemetry signals (pressure pulses) corresponding to data to be transmitted to the surface in accordance with signals from the primary electronics 625 and other circuitry contained in the drilling assembly 600. As noted above, the mud-driven power generation units and pulsers are known. In the present invention the electrical power generation unit and/or the pulser is a module that can be connected to the steering module 610 and/or which can be placed at other suitable locations in the drilling assembly 600.

Referring back to FIG. 5, a stabilizer module 530 having one or more stabilizing elements 531 is disposed above the BPCM 520 to provide lateral subility to the lower part of the drilling assembly 500. In an alternative embodiment, the stabilizing elements 531 may be integrated into or disposed outside of the BPCM 520 as shown by dotted lines 531*a*.

A measurement-while-drilling module or "MWD module" 550, preferably containing a resistivity and a gamma sensor, is removably attached uphole or above the BPCM 520. A directional module 560 containing sensors, such as magnetometers, to provide measurements for determining the drilling direction is preferably placed uphole of the MWD module 550. A logging-while-drilling ("LWD") module 565, containing formation evaluation sensors such as resistivity, acoustic and nuclear sensors is preferably disposed proximate to the upper end of the drilling assembly 500. An alternator/downlink module 551 which detects telemetered data from the surface for use by the drilling assembly 500 may be placed at any suitable location. A memory module 552 is suitably disposed in the MWD module 550. A battery pack module 556 to store and provide back-up electric power may be placed at any suitable location in the drilling assembly 500. Additional modules are provided depending upon the specific drilling requirements. For example, a module 554 containing sensors that provide parameters about the downhole physical conditions, such as vibrations, whirl, slick slip, friction, etc., may be suitably placed in the drilling assembly.

Thus, in one modular embodiment, the drilling assembly includes a lowermost steering module 510 that includes a plurality of modular steering devices 512 and a power and data communication module 520 uphole of the steering module 510. Near bit inclination sensors are included in the steering module 510. The drilling assembly includes an MWD module that contains a resistivity sensor and a gamma sensor and an LWD module that includes at least one formation evaluation sensor for providing information about the formation penetrated by the drill bit. A directional module, containing one or more magnetometers, may be placed at a suitable location in the.drilling assembly to provide information about the direction of the wellbore drilled or penetrated by the drill bit.

Figure 7:
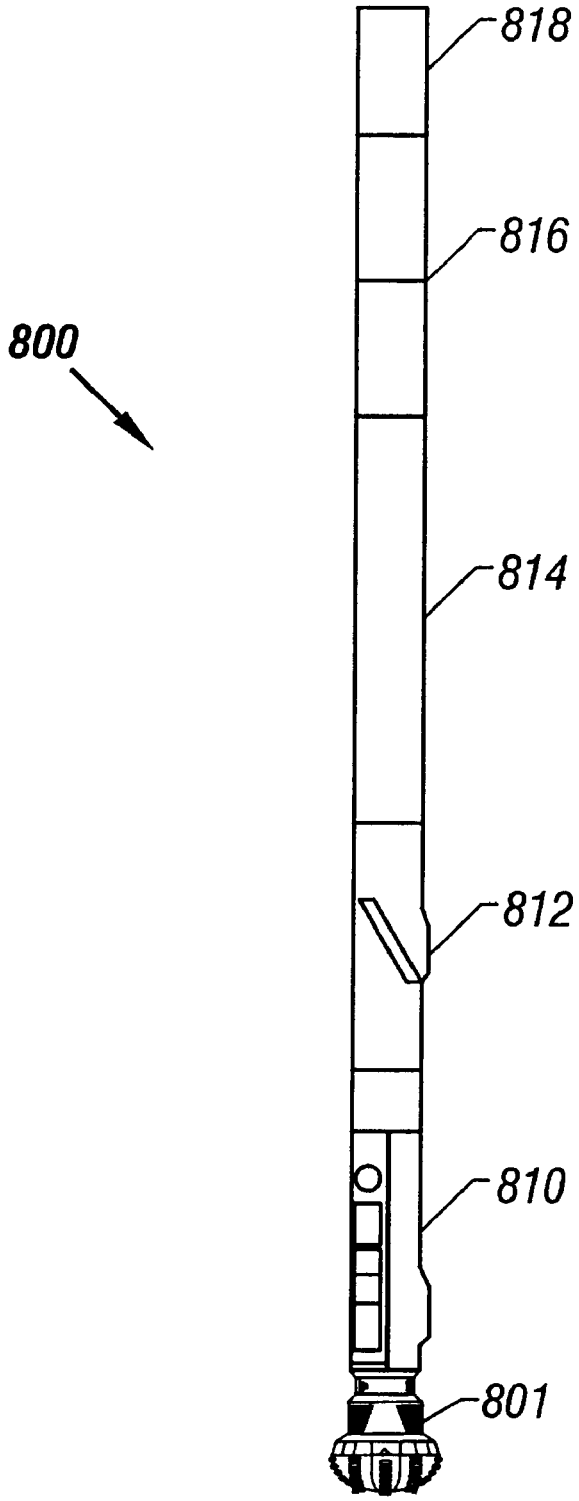
FIG. 7 shows a first alternative modular arrangement for the drilling assembly of the present invention.

FIG. 7 shows an alternative configuration for the modular drilling assembly 800 of the present invention. The lowermost section (above the drill bit 801) is the modular steering unit 810 as described above. The drilling assembly 800 includes a modular BPCM 812, a measurement-while-drilling ("MWD") module 814, a formation evaluation or FE module 816 and a physical parameter measuring sensor module 818 for measuring physical parameters. Each of the modules 812, 814, 816 and 818 is interchangeable. For example, the BPCM 812 may be connected above the MWD module 814 or above the FE module 816. Similarly, the FE module 816 may be placed below the MWD module 814, if desired, although usually MWD module 814 is placed closer to the drill bit since it includes directional sensors. Each of the modules 812, 814, 816 and 818 includes appropriate electrical and data communication connectors at each of their respective ends so that electrical power and data can be transferred between adjacent modules.

Figure 8:
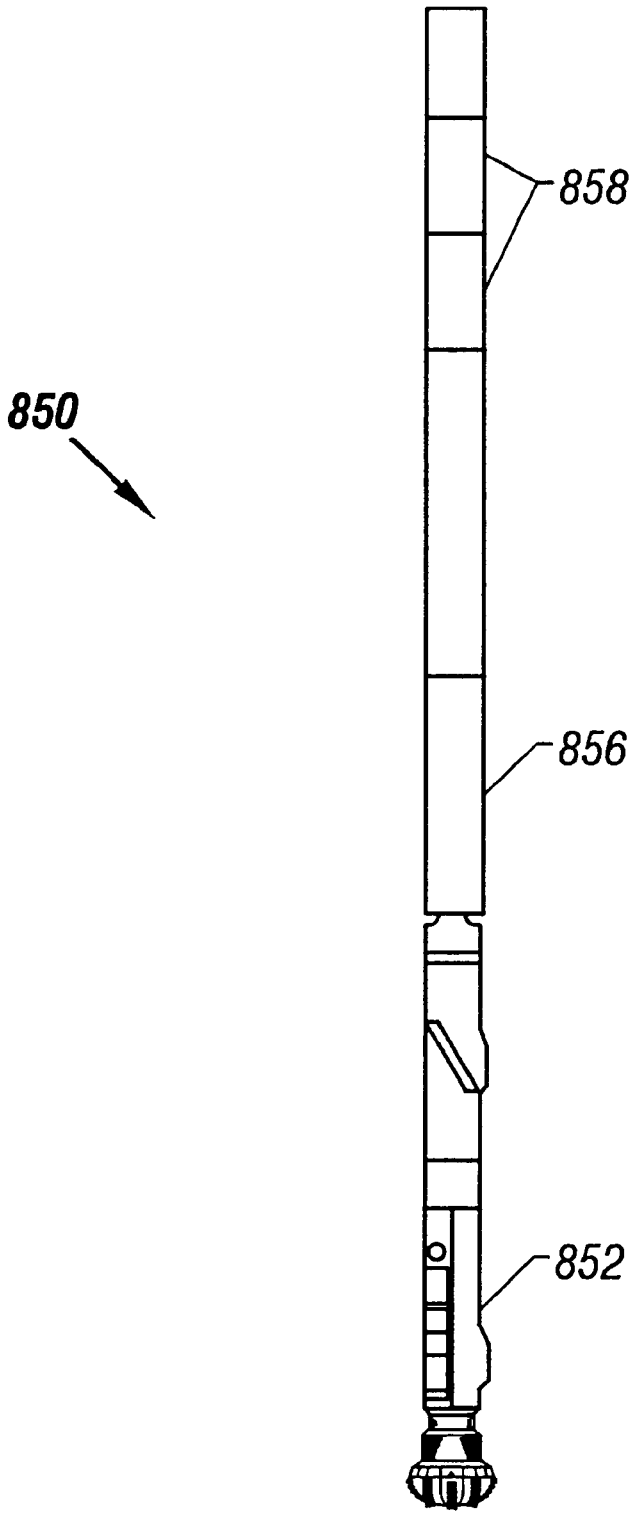
FIG. 8 is a second alternative modular arrangement for the drilling assembly of the present invention.

FIG. 8 shows yet another configuration 850 of a drilling assembly according to an embodiment of the present invention. The drilling assembly 850 includes a modular mud motor section 856 uphole of a steering module 852. The mud motor module or unit 856 includes an electrical connector (not shown) at its each end with one or more conductors (not shown) running through the entire length of the mud motor module 856. The conductors in the mud motor enable transfer of power and data between the two ends of the motor module 856, thereby allowing power and data transfer between modules uphole and downhole of the mud motor module 856. The mud motor module 856 is placed above the steering module 852 and below FE modules 858 but may be placed at any other place above the steering module 852. The particular modular configuration chosen depends upon the operational requirements.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A modular drilling assembly for drilling a wellbore, comprising:

a steering module at a bottom end of said drilling assembly, said steering module including a substantially non-rotating member outside a rotating member, said non-rotating member including at least one steering device having a pluggable power unit that provides power to a force application member to cause said force application member to extend radially outward from said drilling assembly to exert pressure on the wellbore;

a drill bit carried by said steering module for drilling said wellbore.

2. The modular drilling assembly of claim 1 further comprising an electrical power generation module uphole of said steering module for providing electrical power to said steering module.

3. The modular drilling assembly of claim 1, wherein said pluggable power unit includes a motor, a pump and hydraulic fluid for supplying said hydraulic fluid under pressure to operate said force application member.

4. The modular drilling assembly of claim 1, wherein said steering module further includes an inductive coupling device for transferring power between said non-rotating and rotating members.

5. The modular drilling assembly of claim 1 further comprising at least one module containing at least one sensor for providing measurements for determining a parameter of interest relating to the drilling of the wellbore.

6. The modular drilling assembly of claim 5, wherein said at least one sensor is selected from a group consisting of (i) an inclination sensor; (ii) a formation evaluation sensor; and (iii) a sensor for determining a physical condition of said drilling assembly.

7. The modular drilling assembly of claim 1 further comprising a module uphole of said steering module that is selected from a group consisting of (i) a module containing at least one sensor for determining drilling direction of the wellbore; (ii) a module containing a battery; (iii) a module containing memory to store data downhole; (iv) a module containing at least a resistivity sensor and a gamma ray sensor; (v) a module containing at least one logging-while-drilling sensor; and (vi) a module containing a mud motor for rotating said drill bit.

8. The modular drilling assembly according to claim 1, wherein said pluggable power unit electrically plugs into a secondary electronic circuit carried by said non-rotating member.

9. The modular drilling assembly according to claim 8, wherein said power unit is disposed in a recess in said non-rotating member.

10. A modular drilling assembly comprising a steering module having a substantially non-rotating member operatively coupled to a rotating member, a plurality of interchangeable modules coupled to a drill string, wherein each of the plurality of interchangeable module and the steering module include at least one coupling for intrechangably coupling to one or more other modules of the plurality of interchangeable modules, and a drill bit coupled to a distal end of the drilling assembly.

11. The modular drilling assembly of claim 10, wherein the at least one coupling is a plug coupling.

12. The modular drilling assembly of claim 10, wherein the plurality of interchangeable modules includes at least one of a directional module, a power module, a communications module, a sensor module, and a control module.

13. The modular drilling assembly of claim 10, wherein the steering module includes an inductive coupling device for transferring power between the non-rotating and rotating members.

14. The modular drilling assembly of claim 10, wherein at least one of the plurality of interchangeable modules is located uphole of the steering module and is selected from a group consisting of (i) a module containing a battery, (ii) a module containing memory to store data downhole; (iii) a module containing a resistivity sensor and a gamma ray sensor; (iv) a module containing at least one logging-while-drilling sensor; and (v) a module containing a mud motor for rotating the drill bit.

15. The modular drilling assembly of claim 12, wherein the power module is disposed in a recess in the non-rotating member.

16. A modular steering assembly for use in a drilling assembly, the modular steering assembly comprising a steering module coupled to the drilling assembly, the steering module having a substantially non-rotating member operatively coupled to a rotating member;

one or more modules interchangeably coupled to the steering module; and a dill bit coupled to the steering module.

17. The modular steering assembly of claim 16 further comprising one or more force application modules interchangeably coupled to the steering module and adapted to selectively extend in a generally radial direction from the steering module to contact a wellbore wall.

18. The modular steering assembly of claim 16, wherein the one or more modules includes a sensor module having a sensor for measuring at least one parameter of interest.

19. The modular drilling assembly of claim 18 wherein the sensor is selected from a group consisting of (i) an inclination sensor; (ii) a formation evaluation sensor; and (iii) a sensor for determining a physical condition of the drilling assembly.

20. The modular drilling assembly of claim 16 further comprising a control module for controlling the steering module, the control module being selectively locatable along the drilling assembly.

21. The modular steering assembly of claim 17 further comprising a power module that provides power to the force application module.

22. A steerable drilling assembly, comprising:

a drill string comprising a drill bit coupled to a distal end of the drill string, and a plurality of interchangeable modules disposed at several locations along the drill string, the plurality of interchangeable modules further comprising;

a steering module having a substantially non-rotating sleeve operatively coupled to a rotating sleeve, the steering module being disposed at a first location on the drill string;

a directional module at a second location on the drill string for determining drilling direction; and a power module at a third location on the drill string for providing power to the steering module, wherein each module in the plurality of interchangeable modules includes at least one connector adapted to allow each module in the plurality of interchangeable modules to be relocated to any of the several locations.

23. The steerable drilling assembly of claim 22, wherein the plurality of interchangeable modules further comprises at least one of:

a communications module at a fourth location on the drill string for transferring power and data between modules of the plurality of modules;

a sensor module at a fifth location on the drill string for sending at lease a physical characteristic of the steerable drilling assembly; and a control module at a sixth location on the drill string for controlling the steering module.

* * * * *